US006131532A

United States Patent [19]

Winner et al.

[11] Patent Number: 6,131,532

[45] Date of Patent: Oct. 17, 2000

[54] INFLATABLE SAILBOAT

[76] Inventors: William K. Winner, P.O. Box 1127; David C. Johnson, 742 Lincoln, both of White Salmon, Wash. 98672

[21] Appl. No.: 09/008,196

[22] Filed: Jan. 15, 1998

Related U.S. Application Data

[60] Provisional application No. 60/058,149, Sep. 8, 1997.

[51] Int. Cl.[7] ..... B63B 7/00

[52] U.S. Cl. ..... 114/345; 114/39.14; 441/74; 441/79

[58] Field of Search ..... 114/345, 39.12, 114/39.14, 39.21, 39.32, 102.1, 102.11, 102.12, 102.18, 102.29, 109, 111; 441/65, 66, 74, 79

[56] References Cited

U.S. PATENT DOCUMENTS

| | | | |
|---|---|---|---|
| 2,064,128 | 12/1936 | Smithers et al. | 9/11 |
| 2,513,857 | 7/1950 | Friedrich | 9/11 |
| 2,986,751 | 6/1961 | Baren | 9/310 |
| 3,577,576 | 5/1971 | Lobb et al. | 9/2 |
| 3,657,753 | 4/1972 | Le Blanc, Sr. | 9/310 F |
| 3,996,868 | 12/1976 | Schagen | 114/39 |
| 4,016,823 | 4/1977 | Davis | 114/90 |
| 4,159,688 | 7/1979 | Odoj | 114/39 |
| 4,194,458 | 3/1980 | Messing | 114/39 |
| 4,249,276 | 2/1981 | Snyderman | 9/2 A |
| 4,253,209 | 3/1981 | Carn | 9/310 E |
| 4,462,327 | 7/1984 | Pertramer et al. | 114/90 |
| 4,530,299 | 7/1985 | Ross | 114/39 |
| 4,562,787 | 1/1986 | Adamek et al. | 114/97 |
| 4,735,163 | 4/1988 | Filshie | 114/39 |
| 4,750,446 | 6/1988 | Sussman | 114/345 |
| 4,774,901 | 10/1988 | Baldwin | 114/102.12 |
| 4,936,242 | 6/1990 | Stelniceanu | 114/352 |
| 4,938,162 | 7/1990 | Hanlon | 114/61 |
| 4,964,353 | 10/1990 | Morrelli | 114/102.29 |
| 5,072,682 | 12/1991 | Urroz et al. | 114/91 |
| 5,299,524 | 4/1994 | Szilagyi | 114/345 |
| 5,351,637 | 10/1994 | Brenckmann | 114/39.2 |

FOREIGN PATENT DOCUMENTS

| | | | |
|---|---|---|---|
| 1195882 | 10/1985 | Canada . | |
| 2938211 | 4/1981 | Germany | 440/104 |
| 3130565 | 2/1983 | Germany . | |
| 2171963 | 9/1986 | United Kingdom . | |
| WO 84/03868 | 10/1984 | WIPO . | |

*Primary Examiner*—Ed Swinehart

*Attorney, Agent, or Firm*—Garrison & Associate PS; David L. Garrison

[57] ABSTRACT

An inflatable sailboard consisting of an inflatable hull, a mast, a boom, and a sail, and optionally comprising a removable rigid deck and auxiliary devices such as mast supports and center boards attached to the hull by through-hull fittings. The hull of the invention consists of a plurality of independently inflatable compartments, has a relatively high beam width to length ratio, generally in the range of ⅓ to ⅔, and in preferred embodiments may be employed without mast, boom, or sail, and with an attached seat, as a kayak. The hull may also be towed by a boat or jet ski for sporting use, or may be used as a "boat trailer" to transport supplies or equipment. The sail of the invention incorporates head and foot cups adapted to attach the sail to the mast to control tension within the sail. Preferred masts for use with the invention are provided in a plurality of assemblable sections, and include an adjustable support for the boom and improved hull attachment means. The mast and boom optionally include a telescoping features to facilitate changing between sails of various sizes.

18 Claims, 5 Drawing Sheets

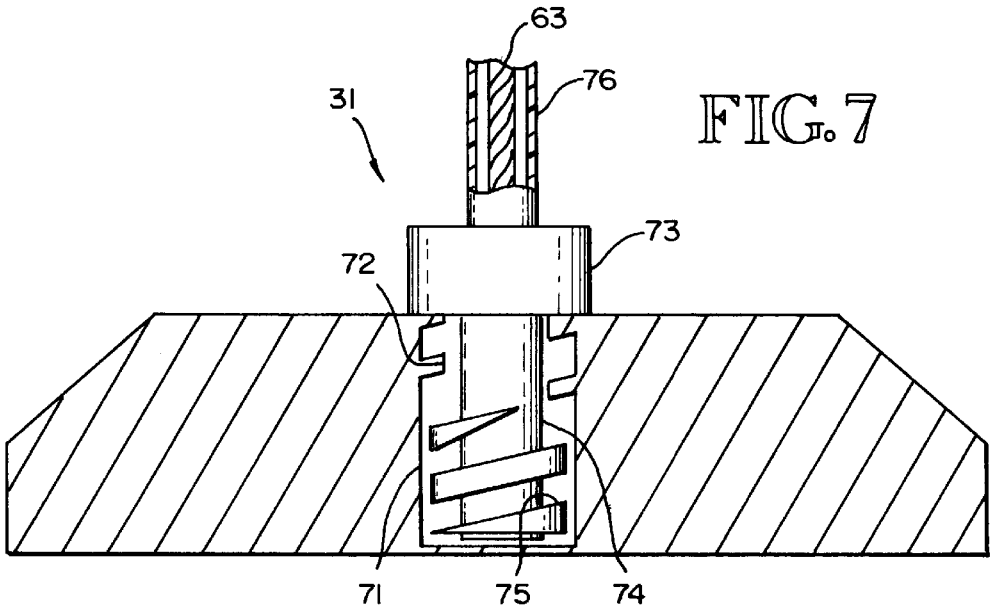
FIG. 7
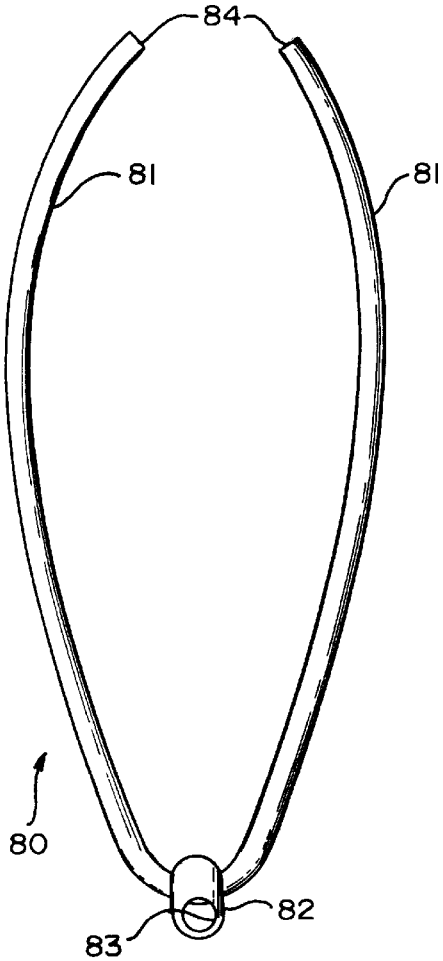
FIG. 8A
FIG. 8B
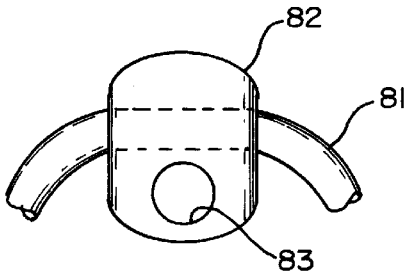
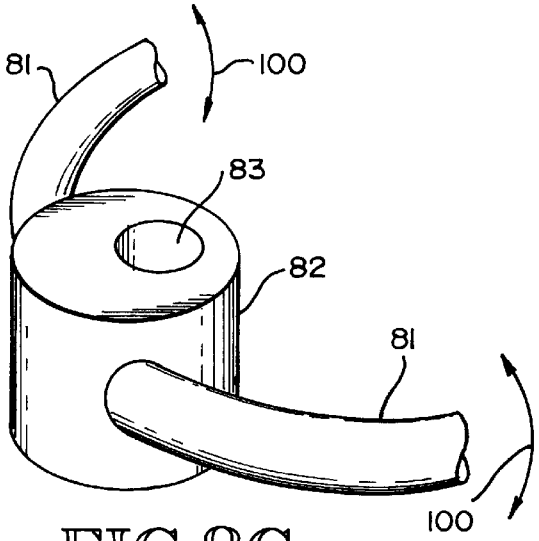
FIG. 8C

INFLATABLE SAILBOAT

This application claims the benefit of U.S. provisional application No. 60/058,149, entitled Inflatable Sailboard, filed Sep. 8, 1997.

TECHNICAL FIELD

The invention relates to collapsible boats; more particularly, it relates to inflatable sailboards and components for use in conjunction with such boats.

BACKGROUND OF THE INVENTION

Sailboards are widely used for recreation, exercise, and for sporting competition. And while they are relatively small and portable, they are ponderous, bulky items compared to other types of things humans usually carry. For example, in order to transport a conventional, rigid-hulled sailboard over any very significant distance, it is typically necessary to strap the board to the top of a vehicle or to place it in a specially-purchased rack on such a vehicle. Yet to place a typical rigid-hulled sailboard on top of a vehicle or in such a rack is difficult—or impossible, for many modestly-sized persons—and for the typical person involves at least unwarranted effort and expense. This is especially true when special made-for-the-purpose racks are used, as they typically involve more manipulation than does the laying of a sailboard on top of a vehicle, and as they are generally relatively expensive.

Various solutions to the problem of the bulkiness of the sailboards have been tried. One attempt has been to provide an inflatable hull for the sailboard, with various rigid components attached, so that the sailboard may to some extent be dismantled and stowed in a small container. Various embodiments of such boards have appeared, but none has proved fully satisfactory. Many of the designs, for instance, have involved rigid decks for attachment to the inflatable hulls, with the deck being substantially the same size as the hull itself—thus requiring essentially the same amount of space to store and transport the board as conventional rigid designs. Typically too, sailboard hulls in general, inflatable and otherwise, have tended to be relatively narrow, or short in beam, so that they have tended to roll excessively and thus to be difficult to handle, and especially difficult to learn to operate. Moreover, none of the means thus far put forth for attaching components—as for example masts, dagger boards, and the like—has proven either fully effective, efficient or reliable. Current designs need improvements in the design and construction of the hull, the mast, the sail, the boom, and most associated equipment. For example, most collapsible masts are bulky and difficult to operate, while mast-to-hull attachments are unreliable and restrict beneficial movement of the mast with respect to the hull. The attachments of sails to masts and booms is unreliable, and typically makes no allowance for adjustment of tension within the sail to allow for weather and the skill of the sailboard user. Mast-to-boom attachments are typically designed statically, so that no adjustment may be made for the size or skill of the operator. Mast, dagger board, and keel board attachments are unreliable, and either too flexible or not flexible enough, or are difficult or time consuming to attach or assemble. And virtually all sailboard designs fail to allow for other uses of the hull—as for example to allow the hull to be used as a simple flotation device, or to be towed behind a boat or jet-ski with a rider aboard, or for the purpose of transporting equipment and supplies, like a "water trailer", much less to be used with a removably mounted seat as a type of kayak. Similarly, boom design has been stagnant, the typical boom accommodating sails of only one size, with little tolerance for variation.

In short, none of the designs has provided a fully integrated, simple to use, easily assembled, reliable collapsible sailboard capable of being carried and stored easily and of being used in a variety of ways for different forms and styles of recreation.

Thus there is a need for a fully integrated, simple to use, easily assembled, reliable collapsible or inflatable sailboard capable of being carried and stored easily, and of being used in a variety of ways for different forms and styles of recreation, and having effective, efficient, and reliable means for the attachment of components and auxiliary equipment. And the provision of an affordable, cost-effective system of such type would be more beneficial yet.

DISCLOSURE OF THE INVENTION

Accordingly, it is an object of the invention to provide a fully integrated, simple to use, easily assembled, reliable collapsible or inflatable sailboard capable of being carried and stored easily, and of being used in a variety of ways for different forms and styles of recreation, and having effective, efficient, and reliable means for the attachment of components and auxiliary equipment.

It is a further object of the invention to provide such a system in an affordable, cost-effective form.

It is a further object of the invention to provide such a system in a collapsible or dismantlable, easily stored and transported form.

It is a further object of the invention to provide such a sailboard with effective, efficient and reliable attachments for components and auxiliary equipment which are neither too flexible or too inflexible.

It is a further object of the invention to provide a collapsible mast for an inflatable sailboard which may be quickly, easily, and reliably assembled or broken down for storage, and which is effective and efficient.

It is a further object of the invention to provide an attachment for a removable mast for an inflatable sailboard which is reliable, efficient, effective, and durable.

It is a further object of the invention to provide a sail, and a sail-to-mast attachment, for a sailboard which is reliable, efficient, effective, and durable.

It is a further object of the invention to provide a boom and a mast-boom attachment for a sailboard which is reliable, efficient, effective, and durable.

It is a further object of the invention to provide an sailboard and components for an inflatable sailboard which can be assembled and dismantled quickly, with a minimum of tools, or without any tools.

It is a further object of the invention to provide an inflatable sailboard hull which can be used or adapted for a variety of purposes, including use as a kayak, a swimming platform, a flotation device, as a tow-float, and as a "boat" or "water" trailer for transporting equipment or supplies.

It is a further object of the invention to provide an compartmented, puncture-resistant inflatable hull for a sailboard of sufficient width or beam to allow stable operation, and to ease learning and increase sailing enjoyment.

It is a further object of the invention to provide a covered, removable, non-skid deck for such a sailboard.

It is further object of the invention to provide a covering for an inflatable hull according to the invention which will allow the hull to be used for any of the foregoing purposes.

It is yet another object of the invention to meet any or all of the needs summarized above.

These and such other objects of the invention as will become evident from the disclosure below are met by the invention disclosed herein.

The invention addresses and provides such a system. The invention provides an inflatable sailboard consisting of an inflatable hull, a mast, a boom, and a sail, and optionally comprising a removable rigid deck and auxiliary devices such as mast supports and center boards attached to the hull by means of unique through-hull fittings. The hull of the invention consists of a plurality of independently inflatable compartments, and in preferred embodiments may be employed without mast, boom, or sail, and with a removably attached seat, as a kayak. The hull may also be towed by a boat or jet ski for sporting use, or may be used as a "boat trailer" to transport supplies or equipment. The sail of the invention incorporates head and foot cups adapted to attach the sail to the mast to control tension within the sail. Preferred masts for use with the invention are provided in a plurality of assemblable sections, and include an adjustable support for the boom and improved hull attachment means. The mast and boom optionally include telescoping features to facilitate changing between sails of various sizes.

The inflatable sailboard of the invention, and each of its components, may be assembled and dismantled quickly, without the use of tools.

One aspect of the invention provides a sailboard comprising, as herein described, an inflatable hull, an optionally disassemblable mast removably attached to the hull, an optionally disassemblable boom adjustably and removably attached to the mast, and a sail attached to the mast and boom. The sailboard further optionally comprises a substantially rigid, substantially flat or planar deck, which may be either permanently or removably attached to the hull, one or more dagger boards or keel members, and various fittings such as permanently or removably attached fittings adapted for mounting of the mast. A chief advantage offered by the sailboard aspect of the invention is that because the hull is inflatable (by which description it is meant that the hull may be selectively both inflated and deflated, at the option of the user) and each of the fittings or components attached to the hull are optionally removably mounted to the hull, the entire sailboard may be broken down (or dismantled, "collapsed" or disassembled) and stowed in a compact carrying case for easy carriage or storage, with or without removable components. The relative lightness of the inflatable structure of the invention and of its components, together with the ability of the invention to be broken down into its components, also contributes to the portability of the invention, especially as compared to conventional, relatively rigid sailboards having fixed or permanently attached components.

The inflatable hull structure aspect of the sailboard of the invention comprises a plurality of independently inflatable chambers or compartments. In a preferred embodiment a main air chamber is flanked on either side by auxiliary "outside" air chambers and is optionally covered or underlain by one or more auxiliary "safety" air chambers. In optional preferred embodiments the outside air chambers are replaced by a single "perimeter" air chamber which more or less completely surrounds the main air chamber. Such embodiments may of course include auxiliary safety air chambers as well. In preferred embodiments of the hull structure each air chamber or compartment is independently sealed so that it will maintain an internal pressure even if any one or more of the other compartments is vented or punctured. In this way safety of the hull structure is improved, as a partial failure of the structure through disinflation of one or more chambers will not deprive the hull structure of all buoyancy. Moreover, unlike in prior art inflatable hulls, the relative sizing and placement of the hull compartments provides increased stability in the event of the failure of any one or more chambers. For example, venting of the main air chamber will leave both outside air chambers and the safety air chamber(s) pressurized, with the result that the overall hull structure will remain stably and symmetrically buoyant. Likewise, failure of a safety chamber will not affect the stability or symmetry of the hull's buoyancy, while failure of either of the outside air chambers will result in a relatively small loss of buoyancy, and any resultant loss in the symmetry of the buoyancy will be minimal, such that the hull structure will remain substantially "on an even keel." This last effect is especially advantageous in that under most operating conditions the outside chambers will be at greatest risk of puncture or deflation during collision with other objects, etc.

Inflation and deflation of the hull structure may be accomplished by any satisfactory means, many of which are well known in the art of building inflatable structures, and in particular in the art of building inflatable marine structures.

Preferred embodiments of the hull structure comprise an upper surface and a lower surface. The upper surface is optionally provided with a non-skid texturing or coating, in order to provide improved grip and reduce slippage for a user or rider (or "operator") of the board when the board is being ridden, while the lower surface is made as smooth as possible, in order to reduce hydrodynamic or fluid dynamic drag when the hull structure is under way or afloat.

Preferred embodiments of the hull structure comprise generally broader beams (or greater width) than conventional sailboards. Typical sailboards have breadth-to-length ratios of between 1:6 and 1:4; it has been found that providing an inflatable sailboard hull with a breadth-to-length ratio of between approximately 1:3.5 to 1:1.8 provides substantially improved stability, with consequent improvements in operability, particularly during the learning process or in training novices. Thus preferred embodiments of the hull structure of the invention comprise beams having widths between approximately ⅓ and approximately ⅔ the overall length of the hull.

A particularly advantageous feature of the invention is the incorporation within the hull structure of one or more intra-compartmental through-hull channels communicating between the upper and lower surfaces of the hull. These through-hull channels are provided, among other things, for the removable mounting of devices to the hull structure. Devices which might be mounted using these channels include mast mountings, dagger boards or keel boards, seats, and other diverse auxiliary devices. The through-hull channels of the invention are unlike prior art devices provided through instead of between independently-inflatable chambers or compartments of the hull structure. Generally they are substantially cylindrical in shape, with circular openings at the surface of the hull compartment through which they pass and one or more walls (generally cylindrical) extending inwardly through the compartment. Clearly they must in preferred embodiments incorporate airtight seams and joints, so that the airtight integrity of the chamber through which they pass is not voided.

Preferred embodiments of the hull structure aspect of the invention are constructed of 30-guage polyvinyl chloride, or PVC, which requires no special surface treatment or handling to stay watertight and airtight. Joints and seams of this aspect of the invention (including seams and joints involved in the formation and installation of the through-hull channel aspect of the invention) are glued or welded using any suitable process. The invention has been practiced with particular success using radio-frequency welded 30-guage PVC. As will be clear to those having ordinary skill in the art, however, any materials or joint/seaming techniques providing structures of suitable fluid-tight integrity, strength, ultraviolet resistance, durability, and corrosion resistance will serve satisfactorily to practice the invention, once the designer has been provided with the disclosure of the invention. Similarly, the non-skid and smoothness objects described herein are readily supplied through any number of well understood processes or products, once the disclosure has been understood. A particularly advantageous process for providing non-skid surfaces for the hull structure is embossment. Through embossing the fabric of the hull may be impressed with any of a wide variety of highly effective non-skid textures, each of which is well known among designers of non-skid surfaces, at relatively low cost and with excellent durability characteristics. Typically the hull fabric is pressed through any conventional embossing process.

Preferred embodiments of the invention optionally incorporate a substantially rigid and generally substantially planar deck attached to either the upper or lower surface of the hull structure. Such decks may be either permanently or removably attached, and are preferably made from any of a variety of materials, such as wood, fiberglass or other composites, plastic, or even the lighter metals, such as aluminum, and are strong enough to withstand the weight of a relatively heavy, active person operating the boat under stringent conditions without causing undue damage to the hull structure or other components. Preferred attachments for the deck include the substantial enclosure of a deck or deck plate by a covering on the hull structure, as for example by the provision of an additional layer of hull structure material. Such dispositions facilitate the provision on the deck plate or its covering of the non-skid surface herein discussed and provide sure, simple means for installing and removing the deck. Other, already-known means for attaching the deck plate to the outer surface of the upper side of the hull structure include a number of conventional approaches, as for example through the use of hook-and-loop fasteners, snaps, screws, and straps and the like. The designer of ordinary skill in the art, once armed with the disclosure, will not be troubled to find such means to secure the deck to the hull. Attachment of the deck to the upper surface of the hull facilitates stability and ease of operation for the sailboard operator by providing a steady, relatively solid foothold or seat, as will be understood by those skilled in the art of sailboard design, while attachment of a deck (which may be an additional second deck if a deck is employed on the upper surface or a single deck otherwise) to the lower surface allows the boat to plane—that is, to ride up on the surface of the water as a result of fluid dynamic force, aside from plain buoyancy—at higher speeds. Decks are preferably attached to the hull, as described, by enclosure within a layer of hull material, regardless of which surface of the hull they are attached to.

Preferred embodiments of the invention typically provide for the attachment of diverse devices to the hull structure, either by means of the through-hull channels or by direct attachment to the hull surface. For example, preferred embodiments of the invention provide for removable attachment of a mast, either through attachment to a mount fixed directly to the hull structure or by means of fittings engaged by the through-hull channels, or for provision of one or more dagger boards. Preferred embodiments of the invention comprise two dagger boards attached via through-hull fittings; the dagger boards may be either attached by means of fittings passing entirely through the hull, with fastener-type heads on the upper side of the hull, shafts or other supporting structure passing through the through-hull channel, and the dagger board depending beneath the hull structure or by means of fittings attached to the upper surface of the dagger boards and held in place within the through-hull channel by friction between the fittings and the channel walls. It has been found that the use of more than one dagger board in the manner described improves the directional stability and sailing qualities of the sailboard, as will be understood by those familiar with the art. In embodiments employing more than one dagger board the dagger boards may either be disposed in line with each other, as for example along the centerline of the hull, or in tandem or other patterns, as will occur to those familiar with the art. As will be further readily apparent to one of ordinary skill in the art armed with the disclosure of the invention, the amount of frictional force available between a through-hull fitting and the channel walls may be controlled through appropriate relative sizing, spacing, and orientation of the fitting and the channel walls, and optionally by controlling the surface roughness of the fitting and the channel walls—the rougher the surfaces and the tighter the fit, the greater the frictional force available. It has further been found advantageous in some circumstances to control the attachment of auxiliary hull components by controlling the orientation of the through hull channels. For example, a firmer attachment may be accomplished by making the through-hull channels non-parallel, so that the tendency of a removably-mounted component to pull straight out of the channels may be countered Preferred hull structures according to the invention are adapted to serve, without the mast, boom, and sail of the invention installed, as a variety of flotational devices. A principal such optional device is a kayak. By providing a seat adapted for attachment to the hull in the manner described above for dagger boards (that is, either by attachment to mounts attached directly to the hull structure or by means of through-hull attachments) the hull of the invention may be used as a kayak. This use is optionally furthered, as herein described, by employment of a specially-adapted section of a disassemblable mast as a paddle shaft for a pair of removably-attachable paddle heads. In addition, the hull structure of the invention may be used as a swimming or diving platform, as a kayak without a seat, as a floating lounge, or, by providing the hull with a towing ring or as herein elsewhere described, a sport float for towing behind a boat, jet ski or the like.

A further aspect of the sailboard of the invention is a sail for a sailboard having a removable mast, the sail comprising a generally conventional sail area optionally having a transparent portion for facilitating operation of the sailboard and, at its head and foot, a head cup and a foot cup. The head cup and foot cup are adapted to receive, respectively, the head and foot of a mast so as to attach or aid in the attachment of the sail to the mast. In preferred embodiments of the invention the head and foot cups of the sail are made of relatively heavy guage webbing-type material, either integrally formed with the sail (as for example in the form of pocket-like structures) or attached the sail by means of straps (optionally including buckles), ropes, nylon line or the like, or shock cords, springs, or similar devices, or by means of lines or straps passed through grommets in the in the head and foot of the sail, the lines or straps being knotted or otherwise secured after passing through the grommets, so that they may not be pulled through again until the knot is untied. A particular advantage of attaching the head cup and foot cup in many of the manners described is that the cups may easily be removed from the sail, and reinstalled as desired. Many preferred embodiments of the sail aspect of the invention employ box-shaped cups formed of such material and incorporate grommets or like structural devices disposed in the bottom of the cups to facilitate passage of lines, ropes, shock cords or the like for use in securing or helping to secure the mast to the sail board. Typically head and foot cups are sized to substantially conformally fit the head and foot of the mast, so as to reduce slippage and provide a more stable fit. Optional preferred embodiments of the sail aspect of the invention employ head and foot cups made of molded plastics or other polymers, which may be made very economically and can be extremely durable and easy to use.

By attaching one or both of the head and foot cups to the sail by means of adjustable straps or lines, such as strap-and-buckle or adjustable shock cord arrangements, the operator or assembler of the sail board may selectively control tension in the sail. For example, if a stiffer sail is desired, tension in the sail might be increased by taking in strap length; a softer sail might be obtained by loosening the straps.

A further function of a sail provided, according to the invention, with head and foot cups is to attach the mast to the sail board. For example, preferred embodiments of the invention incorporate mast mounts fixed to the hull or deck of the sailboard. To such mounts a flexible line or other universal joint is attached; to the universal joint is attached the foot cup of the sail. The foot of the mast is placed in the foot cup, generally with tension in the foot or head cup straps relaxed, and the head cup put in place over the head of the sail. With tension in the head and foot cups suitably taken up, the mast is held securely to the sailboard, with a very large degree of rotational freedom. Preferred embodiments of the sail are made of dacron polyester; however as will be apparent to one of ordinary skill in the art a wide variety of sail materials will serve satisfactorily.

In a further aspect the invention provides a collapsible mast for a sail board, the mast comprising a plurality of assemblable sections and an adjustable support for a boom. The mast also comprises a foot adapted to engage a hull fitting so that it may effectively be attached to the hull structure of the sailboard. Adaptation of the foot to engage a hull fitting may mean simply that the foot fits into a foot cup of a sail as described herein, or any other adaptation, sizing, or preparation required to ensure proper functioning of the mast as it is mounted. Preferred embodiments of the mast are comprised of two to four sections, depending upon the length of the assembled mast and the desired compactness into which the mast is desired to be packed when stowed; determining the optimal number and length of sections will not trouble the skilled designer armed with this disclosure. Preferred embodiments of the mast sections are comprised of hollow tube, sized such that succeeding sections of the mast fit into the ends or proceedings sections—the lowest section being largest, the next lowest section fitting inside it, the next inside the second, and so on. To prevent successive sections of the mast from sliding completely into each other, the sections are circumferentially crimped at a portion of their length below their highest (as installed) point. Alternatively, successive sections of the mast may be supported, and the overall length of the mast or the fit or tension of a sail attached to the mast may be adjusted, by "telescoping" the mast, the telescoping being implemented by providing a series of detent holes (typically 3 to 6 holes, suitably spaced; typically 1 to 4 inches apart) in an end of a pair of adjoining sections, and providing the end of the other section with a spring button or detent mechanism, so that the ends of the sections may be fitted together and the detent pin placed in the hole corresponding to the desired height of the mast or section length, and the length of the mast or section length or its fit within a sail (or the tension within the sail) may be selectively controlled. In such embodiments crimping of the mast is optional, as the detent mechanism generally provides sufficient security to hold the mast in place. It has been found that anodized aluminum tubes of 1–⅜" outside diameter and 40" length, 1–¼" outside diameter and 48" length, and 1–⅛" outside diameter and 48" length serve well for a three-piece mast intended for use with typical sailboard applications; the lower two sections are crimped 5–6" from their upper ends. As will be appreciated, however, by those skilled in the art, other tubes comprised of other materials and other dimensions will serve satisfactorily for other applications; sections are preferably sized such that they are held together by friction, however, conventional spring-detent or ball detent mechanisms may be used to advantage as well. On disassembly, the sections are pulled apart for into their separate parts for convenient storage. Again, the length of individual sections may be varied to accommodate storage requirements. To speak of the "disassembly" of a component, within the meaning of this specification, is equivalent to saying that the component is being broken down, dismantled, or "collapsed."

A particularly advantageous feature of the mast according to the invention is the provision on at least one of the sections of an o-ring, sized so that it may be selectively vertically positioned on the section upon which it is disposed, for the support upon the mast of a boom for supporting the sail. Depending upon the use to which the sail board is to be put and upon the geometry of the mast, as herein discussed, it is advantageous in many embodiments to provide o-rings for support of the boom on more than one of the mast sections. The selection of proper o-ring materials and geometry will be well within the ability of the designer of ordinary skill once he or she has been armed with the disclosure of the invention.

Yet another advantageous feature of the mast is the optional provision of one or more of the mast sections with means to engage at each end of the section a paddle head, to allow a user to paddle the hull section of the invention, either with or without other hull components attached, in the manner of a kayak. In preferred embodiments this is accomplished by providing each end of the mast section with a spring-pin or spring-loaded detent mechanism to engage a hole in a paddle head (or vice versa). Typically the spring-detent system is also a feature in the assembly of the mast, as herein elsewhere described.

A further aspect of the sailboard of the invention is a mast mount for attaching the mast to the hull structure and/or the deck of the sailboard. Preferred embodiments of the mast mount are adapted to engage a through-hull channel communicating between the upper and lower surfaces of the hull structure and to engage the foot of the mast, and to engage or attach a shock cord, line, or other joint or universal joint attached to the mast. Mounts of this preferred type comprise a pair of tubes, the first adapted to releasably engage an interior surface of the through-hull channel and comprising an axial bore having an inner surface and two ends, there being at the first end a flange adapted to engage a surface of the hull structure, or of a deck attached thereto, and the second end being adapted to receive a flanged cap. The second tube is adapted to engage the inner surface of the axial bore of the first tube and to releasably and lockingly engage the first tube, as by a lockable-type threading, and comprises a foot end adapted to engage the foot of the mast, and an axial bore adapted to receive and secure the shock cord, line or other universal joint. The type of thread employed to provide the locking effect described is preferably the pin-and-slot type that allows the tubes to engage each other by means of a 180 degree turn, and then to lock with a slightly greater turn. Typically then by pushing the tubes together and twisting them in the reverse direction the engagement may be released. Mounts of this preferred type are advantageously fabricated of anodized aluminum or any of a variety of plastics or metals.

An alternative preferred embodiment of the mast mount comprises a block having a central bore which is at least partially threaded, a fitting comprising a dependent shaft having a matching thread over at least a portion of its length, an anchoring line (or other universal joint) attached to the dependent shaft and adapted to be attached to the mast, typically in the foot portion of the mast, and (in embodiments employing an anchoring line) a protective sleeve disposed about the portion of the anchoring line proximate the dependent shaft, the sleeve being so disposed as to protect the line from galling, binding, chaffing, and wear and tear generally due to bearing or rubbing on the block. Like the first embodiment discussed above, this embodiment of the mast mount is not limited to the attachment of a mast, but may advantageously employed with a wide variety of sail board components, including for example keel boards or dagger boards or kayak seats, with the anchoring line or other universal joint being attached to the component mounted. Embodiments of this type are fabricated from any of a variety of nylons, plastics, or metals, as will occur to the skilled designer armed with this disclosure. Typically the block of the invention is attached directly to the hull structure, or to the upper deck of the sail board.

In either case, to say that a mast mount according to the invention engages a foot end of a mast may mean that the foot end is engaged either directly or indirectly. For example, in preferred embodiments of the sail board of the invention, the mast mount is attached directly to the foot cup of a sail, which itself directly engages the foot of the mast. This is, for purposes of the invention, considered to mean that the mast mount has engaged the foot of the mast.

A further aspect of the sailboard of the invention is an improved boom. The boom comprises one or preferably two boom members adapted to hold one end of the sail (the end distal to the mast) spread from the end of the sail attached to the mast and a headpiece adapted to circumferentially engage the mast, or at least one assemblable mast section of a collapsible mast, and to secure the boom member(s) in relation to the mast. Preferably the length of the boom member(s) is adjustable, so that tension in the sail may be adjusted and so that the boom may be adapted for use with sails of differing sizes. A preferred method for making the length of the boom member(s) adjustable is to make the boom in at least two tubular sections, with the section distal to the mast sized to fit slidably inside the section proximate the mast, and to provide the inner end of the distal portion with an asymmetrically shaped plug, so that rotation of the distal section within the proximal end will allow the position of the distal end to be selectively locked or released with respect to the proximal end—that is, to provide the boom member with a conventional "telescoping" mechanism, such as is already well known. Alternatively, the length of the boom (and consequently the fit of and tension in the sail upon the boom) may be adjusted through the use of spaced detent holes and spring-ball detents, as described above for the mast. Like the mast, the boom member(s) is preferably fabricated of anodized aluminum, although a variety of metals, plastics, woods or the like will serve. Alternative preferred embodiments of the boom comprise two boom members integrally formed of a single continuous tubular piece, formed to pass through a boom fitting member and curved such that the ends of the piece form substantially parallel members.

Preferred embodiments of the boom portion of the invention are rotatably attached to the mast by means of a fitting adapted to circumferentially engage the mast while securing the boom member(s). In embodiments incorporating the o-ring support herein described, the boom fitting, or "headpiece", rests on top of the o-ring to allow the boom to rotate freely about the mast; preferred boom fittings comprise an inset groove to allow the fitting to seat itself upon the upper portion of the O-ring, thus providing more security and greater control in the operation of the boom. Preferred embodiments of the boom fitting further allow rotational movement of the boom, so that the distal end of the boom may be moved up or down vertically, to control tension in the sail and aerodynamic performance of the sail, and to improve operator stability and comfort. Boom attachment fittings are preferably fabricated from any of a variety of metals, plastics, woods, or like materials. It has been found that fittings molded from nylon, plastics, or other polymers serve very well.

A further aspect of the sailboard of the invention comprises a hull covering for an inflatable sailboard hull. The covering is comprised of flexible fabric sized to substantially enclose the hull, and comprises a towing fitting attached to the covering at a location proximate an end of the hull when the covering is disposed about the hull. Preferred embodiments of the covering resemble large bags sized and cut to fit substantially conformally the hull structure of the sailboard and are comprised of puncture-resistant material, typically adapted, through the use of added structural stringers and ribs and / or through relatively close material fit and added material thickness, to structurally support the hull. Puncture resistance is achieved through increased material gauge and/or through the use of puncture resistant materials such as Kevlar. Preferred embodiments optionally include an enlarged storage space, generally located on or proximate the upper surface of the hull structure or deck and comprised of water-resistant material adapted to resist admittance of water, as for example by proper tailoring, seaming, joining, and surface treatment. Such storage spaces may either provided either as integral compartments for the covering or as separate attachable bags, attached to the hull be means of snaps, hook and loop fasteners, zippers or the like, or they may be strapped to the covering or to the hull structure. Preferred materials for fabrication of the hull covering of the invention include 400–600 denier nylon and similar materials; as will be apparent to those of ordinary skill in the art, other materials may be employed satisfactorily as well.

BRIEF DESCRIPTION OF THE DRAWINGS

FIG. 7 is a schematic sectional view of a preferred embodiment of a mast mount according to the invention.

FIG. 8*a* is a schematic plan view of a preferred embodiment of the boom aspect of the invention. FIG. 8*b* is a plan view of a preferred embodiment of a boom headpiece according to the invention. FIG. 8*c* is a perspective view of preferred embodiments of a boom headpiece and boom members according to the invention.

BEST MODE OF CARRYING OUT THE INVENTION

Figure 1:
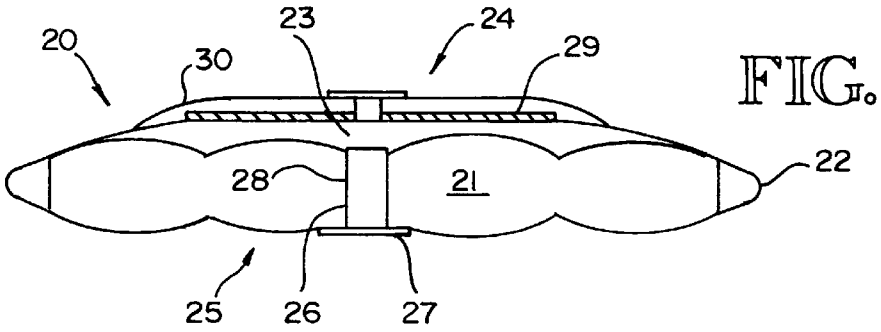
FIG. 1 is a sectional view of a preferred embodiment of the hull structure of the invention.

Turning now to the drawings, the invention will be described in a preferred embodiment by reference to the numerals of the drawing figures wherein like numbers indicate like parts.

FIG. 1 is a sectional view of a preferred embodiment of the hull structure of the invention. Hull structure 20 comprises a plurality of independently inflatable air chambers or compartments, including main air chamber 21, outside air chambers 22 (which might optionally take the form of a single perimeter air chamber substantially surrounding main air chamber 21), and safety air chamber 23. Substantially rigid deck 29 is substantially enclosed by and attached to upper surface 24 of the hull structure by covering 30. Upper surface 24 of the hull structure incorporates non-skid surface 96 (see FIG. 9) while lower surface 25 is hydrodynamically smooth to reduce drag as the hull structure moves through water. Through-hull channel 26 is disposed within main air chamber 21, and comprises surface opening 27 and wall 28. Although preferred through-hull channels communicate with both the upper and lower surfaces of the hull structure (including cases in which channels pass through rigid deck 29), it is understood that in many applications, such as those in which a hull component is to be attached to the hull by friction between a fitting and wall 28 of the channel instead of by means of a flanged cap as herein described, channel 26 will communicate with one surface only. Such configurations are regarded as falling within the meaning of the term "through-hull channel" and therefore as within scope of the invention.

Figure 2A:
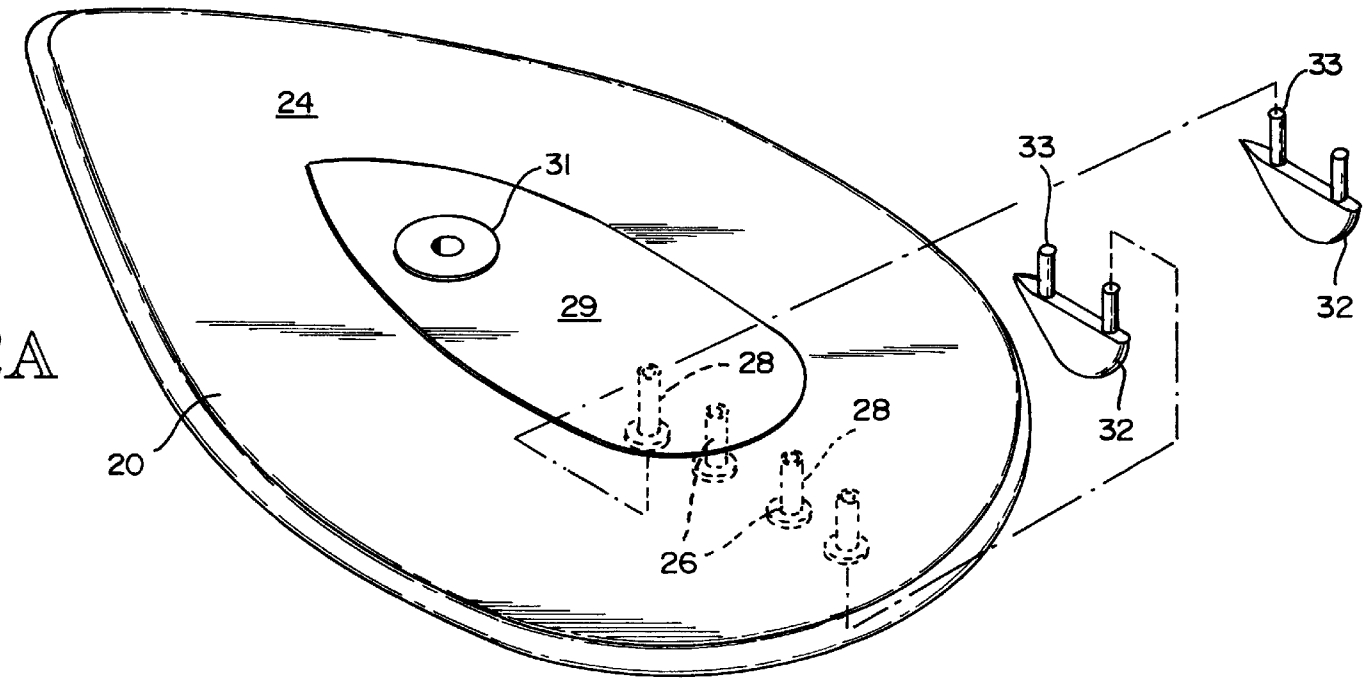
FIG. 2*a* is a schematic view of a preferred embodiment of the hull structure of the invention.
Figure 2B:
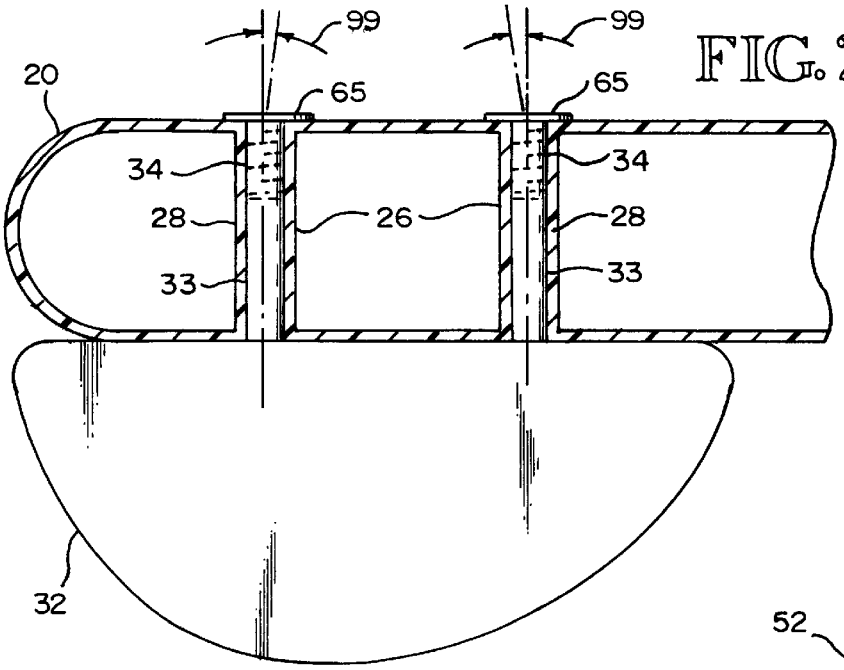
FIG. 2*b* is a sectional view of a preferred embodiment of a through-hull channel mounting according to the invention.

FIG. 2*a* is a schematic view of a preferred embodiment of the hull structure of the invention. Substantially rigid and substantially planar deck 29 is in place on upper surface 24 of hull structure 20. Four through-hull channels 26 are disposed along the length of the hull structure, and are ready to receive dagger boards 32, which will be attached to the hull structure by placement of mount fittings 33 in the channels. Dagger boards 32 will be held in place by means of friction acting between mount fittings 33 and cylindrical walls 28 of the channels. In addition, mount 31 is attached to deck 29 to receive and support a mast (not shown). In FIG. 2*b* is shown a schematic sectional view of an alternate means of attaching a dagger board to the hull structure. Dagger board 32 is in place with mount fittings 33 inserted into channels 26; fittings 33 in this instance comprise threads 34 which, by engaging mating threads on flanged caps 65, serve to retain the dagger board within the channel. As will be appreciated, any frictional forces acting between fittings 33 and walls 28 of the channels will supplement the dagger board's support. The retaining force available through the fitting may also be increased by offsetting through-hull channels 26 through angles 99. In preferred embodiments angles 99 may vary independently from zero degrees (no offset, so that each channel is perpendicular to the hull surface and parallel to its counterpart) through approximately 30 degrees, in either direction, in tandem (i.e., tending to remain parallel, though non-perpendicular to the surface of the hull structure), in opposition, or otherwise.

Figure 3B:
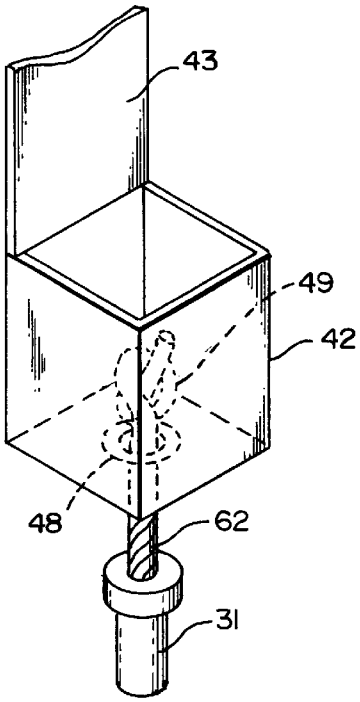
FIG. 3*b* is a schematic detail of a mount fitting and foot cup of the sail.
Figure 3A:
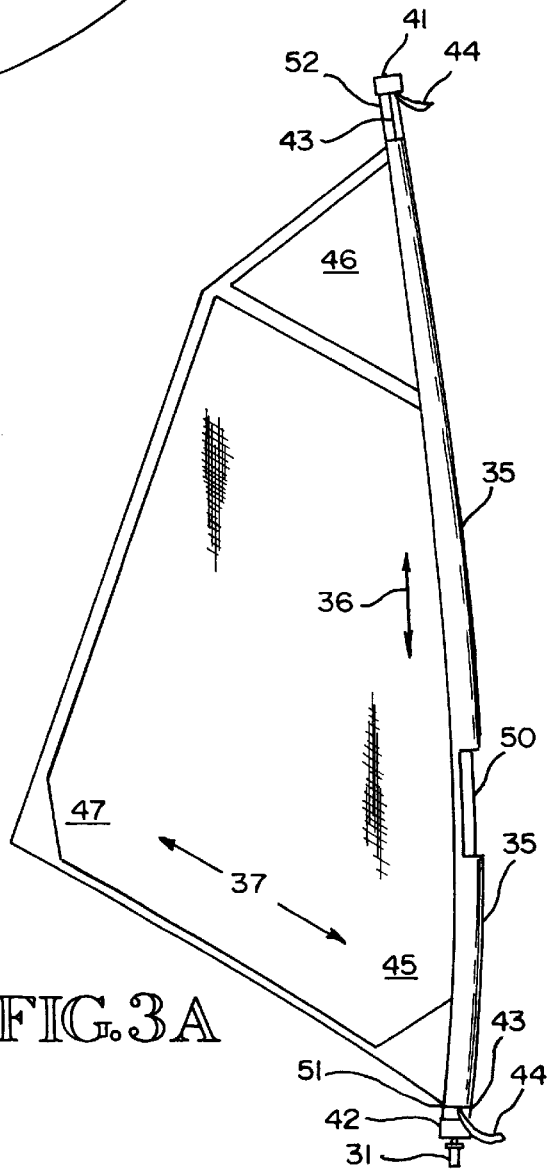
FIG. 3*a* is a schematic view of preferred embodiments of the sail and mast aspects of the invention.

FIG. 3*a* is a schematic view of preferred embodiments of the sail and mast aspects of the invention. Head cup 41 and foot cup 42 are attached to sail 40 by means of attachments 43, which are depicted as buckled straps. Mast 50 is in place inside sail channel 35, which has been formed by wrapping sail material around the mast and placing a sufficiently large hem in sail 40. Foot cup 42 is sized to substantially conformally fit and receive foot 51 of the mast, while head cup 41 is sized to substantially conformally fit head 52 of the mast; the cups act to attach the sail to the mast through attachments 43. In the embodiment shown, cups 41 and 42 act in conjunction with sail channel 35 in attaching the sail to the mast, but in many preferred embodiments cups 41 and 42 will serve that purpose alone. With the sail attached to the mast, tension in the sail may be adjusted in the direction of arrows 36 by adjustment of attachments 43, in the case depicted by pulling strap ends 44 so that slack is removed from the attachments and the sail; tension is maintained by means of buckles attached to the sail and the straps. In many embodiments shock cords replace straps and buckles as attachments 43. FIG. 3*b* is a schematic detail of a mount fitting and foot cup of the sail. Foot cup 42 is formed of nylon webbing sewn into the shape of a box, or plastic molded into the shape of a box, and is attached to the foot of the sail by means of strap 43. Anchor line 61 is attached to mount fitting 31 and passes into box 42 via grommet 48, it is knotted to form stop 49, which prevents the anchor line from pulling back out of cup 42. When mount 31 is attached to the hull structure of a sailboard, placement of the foot of a mast in cup 42 and the head of the mast in a head cup allows a lifting force on the mast to be reacted by tension in the head cup, its attachment to the head of the sail, tension in the sail in the direction of arrows 36, tension in the attachment for the foot cup and in the foot cup, tension in the anchor line, and finally in the mount fitting, which dissipates the force to the hull structure. Anchor line 61 serves to resist translational displacement of the foot of the mast in any direction, but allows free rotation in all directions; anchor line 61 thereby serves very effectively and advantageously as a universal joint in attaching the mast to the hull structure. The anchor line and grommet mechanism depicted in the Figure may also be used to attach the sail to either or both of the head and foot cup.

Figure 4:
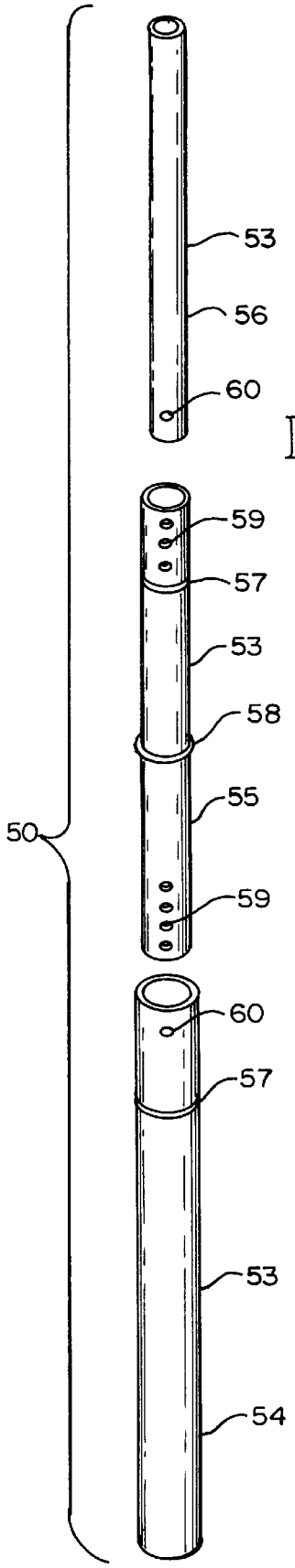
FIG. 4 is a schematic exploded view of a preferred embodiment of the mast aspect of the invention.

FIG. 4 is a schematic exploded view of a preferred embodiment of the mast aspect of the invention. Mast 50 is comprised of sections 53, including lower or foot section 54, center section 55, and top or head section 56. Each of the sections is comprised of hollow tube, they are sized such that the outer surface of center section 55 fits easily but substantially conformally inside the upper end of foot section 54 and the outer surface of head section 56 fits easily but substantially conformally inside the upper end of center section 55. Preferred embodiments of the mast assembly are held together by a combination of close fit and friction and the action of spring ball detents 60 mating with detent holes 59. The height of the assembled mast, and the fit of the mast to any sail attached to it, may be controlled by causing detents 60 to engage any of detent holes 59. Further support and proper orientation are provided by crimps 57, which prevent inner sections from sliding too far into outer sections. An adjustable support 58 is provided for a boom (not shown); the support allows the boom to be selectively vertically positioned on the mast while allowing the boom to rotate freely both vertically (in the direction of arrows 100 in FIG. 8*c*) and horizontally about the mast. In the Figure support 58 is depicted as an o-ring sized to fit snugly about the center section of the mast. To adjust the boom height, it is necessary only to slide the o-ring up and down the section. Through proper sizing, however, sufficient support for the boom is readily available. The proper sizing of an o-ring to serve this function will not trouble the skilled designer. It is to be noted that the preferred embodiment of the center section depicted in the Figure comprises two detent holes to match the spring ball detents located at mating positions in the upper and lower mast sections. This is so that (as depicted) the center section may be used as the handle for a paddle by the attachment of paddle heads, as herein described. In alternative preferred embodiments, an upper section of the mast is used adapted for use as a paddle handle; any section may be adapted to serve satisfactorily.

Figure 5:
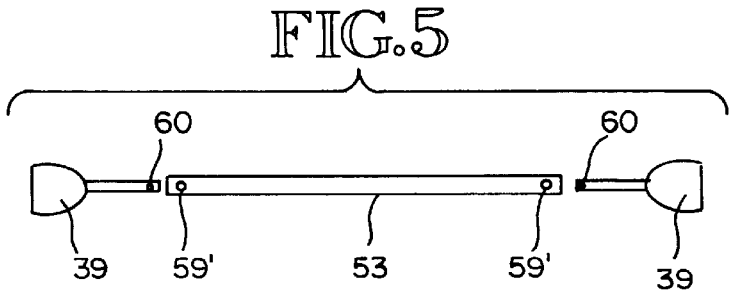
FIG. 5 is a schematic view of a built-up paddle according to the invention.

FIG. 5 is a schematic view of a built-up paddle according to the invention. Paddle heads 39 comprise on their shafts spring ball detents 60 so that the shafts may be run into section 53 of the mast and mated with detent holes 59' such that a sturdy paddle will be formed. The paddle may then be used to propel the hull structure of the invention, as for example when the hull is used as a kayak or float, or when required for safety or navigational purposes.

Figure 6:
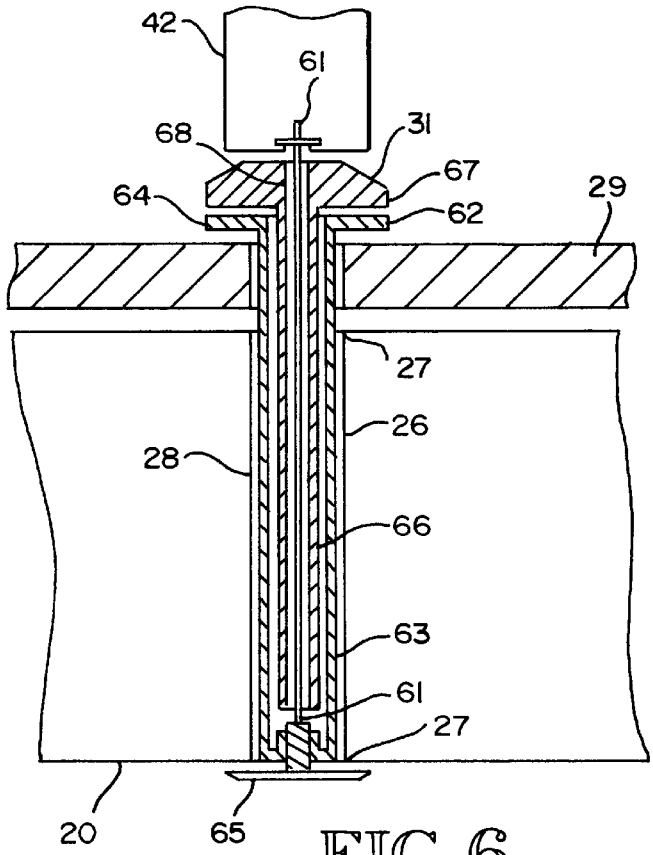
FIG. 6 is a schematic sectional view of a preferred embodiment of a mast mount according to the invention.

FIG. 6 is a schematic sectional view of a preferred embodiment of a mount for a mast or other component. First tube 62 of the mount is securely in place within through-hull channel 26 with flanged end 64 abutting deck 29 and the lower end of the tube (depicted as threaded) engaged by flanged cap 65. Second tube 66, which comprises mount block 31, is in place with its dependent shaft disposed inside axial bore 63 of the first tube. By conventional pin-and-slot arrangements the second tube is securely but releasably engaged within the first tube by rotating the second tube through approximately 180 degrees; to remove the tube using such an arrangement the second tube is pushed slightly further into the first and rotated in the reverse direction. Second tube 66 further comprises axial bore 68, within which anchor line 61 is secured by any conventional means. Anchor line 61 extends beyond the upper extremity of mount 31 to pass into foot cup 42 of the sail and thereby secure the mast, as herein elsewhere described.

An alternative preferred mount for masts and other components is depicted schematically in FIG. 7. Mount block 69 comprises central bore 71, which at the upper or initial portion of the bore's length comprises thread 72. Fitting 73 with dependent shaft 74 fits inside bore 71, initially by threading the mating thread at the lower (or initial) portion of its length through thread 72 and then by merely sliding in. The partially-threaded arrangement depicted allows fitting 73 to be retained securely within the mount without being pulled free by any upward tension on the fitting, but to rotate freely within the bore; and to be easily removed by deliberate counter-rotation through the threads when disassembly is desired. Anchor line 61 is attached to fitting 73 by any convenient conventional means giving satisfactory strength for holding the mast or other fitting in place. In preferred embodiments in which anchor line 61 is restrained within an axial bore in fitting 73, as described above for the alternate mount fitting, relatively soft protective sleeve 76 is provided. Sleeve 76 is generally long enough to protect the anchor line from wearing, binding, or galling against the mount, but short enough to prevent the sleeve from interfering with the operation of the anchor line as a universal joint in restraining the mast or other component, or to interfere with the operation of the attached component.

FIG. 8*a* is a schematic plan view of a preferred embodiment of the boom aspect of the invention. Boom 80 comprises boom members 81 continuously formed of a single tubular piece and rotatably attached to the mast, in the embodiment shown, by headpiece 82. Distal ends 84 of the boom are adapted to hold end 47 of sail 40 (shown in FIG. 3*a*) away from the mast and to spread it from end 45 of the sail held proximate to the mast. Distal end 47 of the sail may be secured by any conventional means, as by tying of a line or by use of straps and buckles, snaps, or even rivets. Boom 80 is attached to the mast by placing hole 83 in headpiece 82 over the upper end of one of mast sections 53 and allowing the headpiece to slide down the mast section until it rests upon the top of adjustable boom support 58 (see FIG. 4). In alternative preferred embodiments boom members 81 may be formed in two or more sections (they may, in such embodiments be straight, or more substantially so than shown in FIG. 8*a*) in the manner of collapsible mast 50, and joined telescopically in the manner herein elsewhere described. FIG. 8*b* is a plan view of a preferred embodiment of a boom headpiece according to the invention, while FIG. 8*c* offers a perspective view of preferred embodiments of a boom headpiece and boom members according to the invention.

Figure 9:
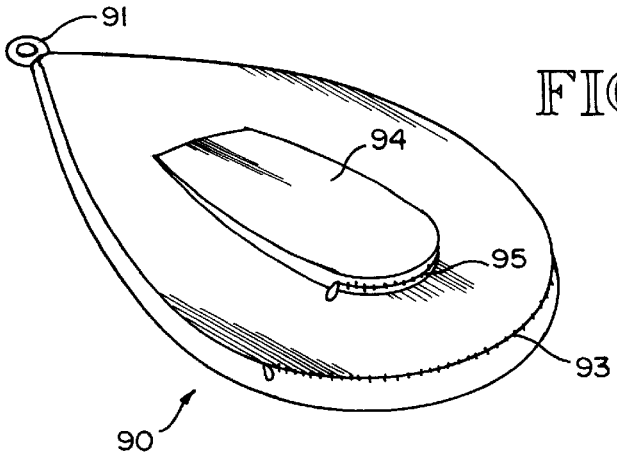
FIG. 9 is a schematic view of a preferred embodiment of a hull covering according to invention.

FIG. 9 is a schematic view of a preferred embodiment of a hull covering according to invention. Covering 90 is comprised of flexible fabric and is sized to substantially enclose hull structure 20. Covering 90 further comprises towing fitting 91, disposed at an end of the bag corresponding, when the bag is in place about the hull, to bow 92 of the hull structure. Covering 90 is installed by opening covering opening 93 (depicted as a zipper, although snaps, buckles, or other conventional means will serve), pulling the covering over the hull structure or inserting the hull structure into the covering, and closing the opening. The covered hull structure may then be towed behind a motor boat, jet ski, or comparable vehicle, for recreational, safety, or transportation purposes. Preferred embodiments of the hull covering are puncture-resistant and are provided with a storage compartment (preferably waterproof) such as that indicated by reference 94. Storage compartment 94 may be integrally formed with covering 90, permanently attached (as by sewing, etc.), or removably attached, as by snaps, hook and loop fasteners, zippers, or various other conventional means. It may also be strapped in place. In any case, supplies or equipment, as will be apparent, may be placed within the compartment through opening 95.

Figure 10:
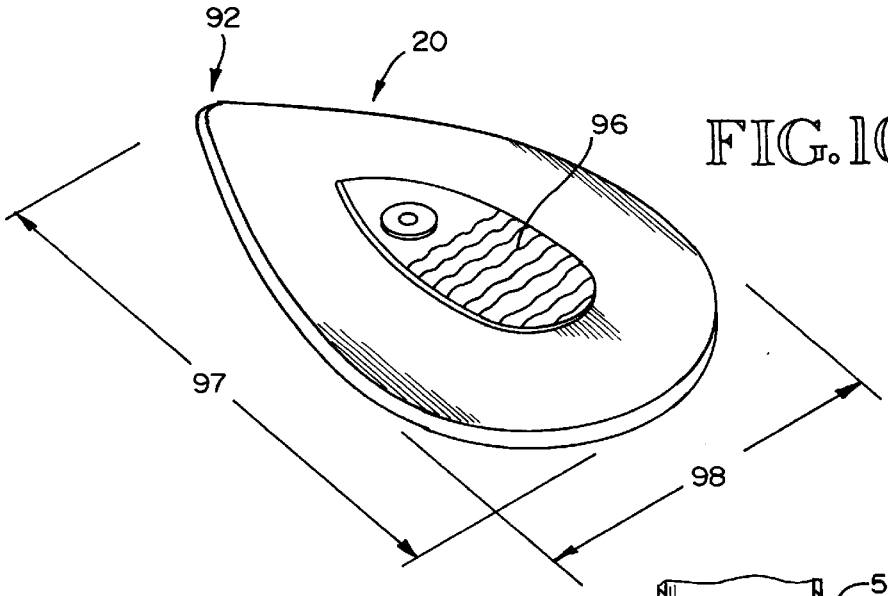
FIG. 10 is a perspective view of a preferred embodiment of a hull structure according to the invention.

FIG. 10 is a perspective view of a preferred embodiment of a hull structure according to the invention. Hull structure 20 has overall length 97 and maximum beam width 98;

maximum beam width 98 is approximately one-half of overall length 98, such that the beam-to-length ratio of hull structure 20, as pictured, is approximately ½. For preferred embodiments of the invention, beam-to-length ratios between approximately ⅓ and approximately ⅔ provide improved stability, make operation of the hull structure and/or sailboard easier, and facilitate training or learning of new operators.

Figure 11:
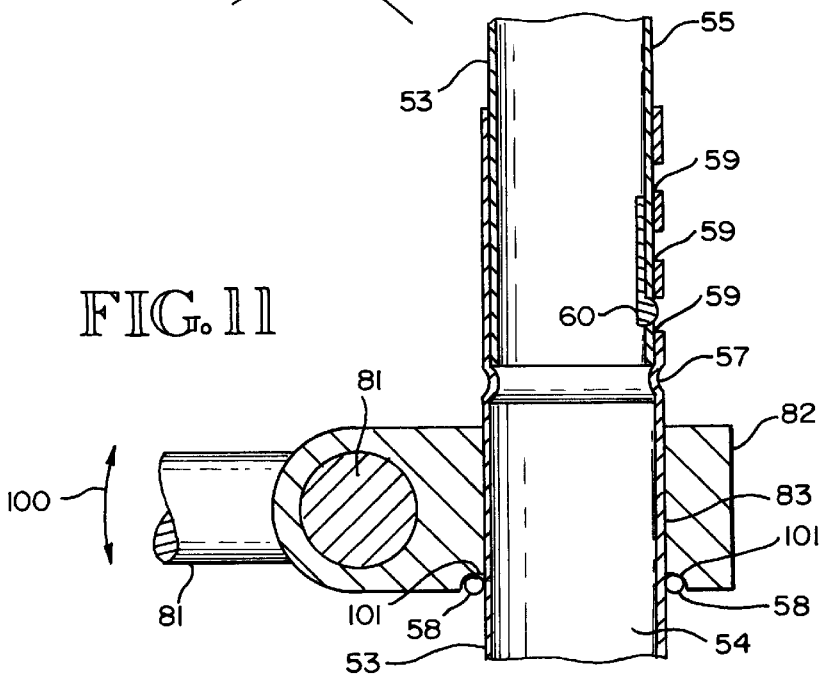
FIG. 11 is a cutaway schematic view of a preferred embodiment of a collapsible mast and boom support according to the invention.

FIG. 11 is a cutaway schematic view of a preferred embodiment of a collapsible mast and boom support according to the invention. Boom support fitting or headpiece 82 is in place about mast section 53 (shown as foot section 54), supported by o-ring 58, which is recessed inside inset groove 101 of the headpiece, and free to rotate about the mast. Boom member 81 is in place through hole 83 in the headpiece, which allows the boom member to rotate vertically, in the direction of arrows 100. Also shown is the placement of detent button 60, mounted on mast center section 55 in one of detent holes 59 in foot section 54 of the mast, so that the height or length of the mast may be adjusted. The lower end of center section 55 rests upon and is supported by crimp 57 in the foot section.

With regard to systems and components above referred to, but not otherwise specified or described in detail herein, the workings and specifications of such systems and components and the manner in which they may be made or assembled or used, both cooperatively with each other and with the other elements of the invention described herein to effect the purposes herein disclosed, are all believed to be well within the knowledge of those skilled in the art. No concerted attempt to repeat here what is generally known to the artisan has therefore been made.

INDUSTRIAL APPLICABILITY

The invention has applicability to the field of watercraft, and in particular to collapsible wind-propelled sport and recreational vehicles. The invention provides improvements in collapsibility, operation, and durability of such vehicles.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

What is claimed is:

1. A sailboard comprising:

an inflatable hull, the inflatable hull comprising a plurality of independently inflatable compartments, the hull further comprising an upper surface and a lower surface and at least one intra-compartmental through-hull channel communicating therebetween;

a mast removably attached to the hull;

a boom adjustably and removably attached to the mast; and a sail attached to the mast and boom, the sail adapted to removably receive the mast in head and foot cups attached to the sail, the sail thereby attached to the mast;

said hull comprising a maximum beam width which is between approximately ⅓ and ⅔ an overall length of the hull.

2. The sailboard of claim 1, the sailboard further comprising a substantially rigid deck attached to the inflatable hull.

3. The sailboard of claim 2, wherein the deck is substantially enclosed by a covering on the inflatable hull.

4. The sailboard of claim 1, the sailboard further comprising at least one dagger board attached to the hull by means of a fitting engaged by at least one said intracompartmental through-hull channel.

5. The sailboard of claim 1, the sailboard further comprising a mast mount attached to the hull by means of a fitting engaged by the communicating channel, the mast mount adapted to releasably engage a foot of the mast, and thereby to support the mast.

6. The sailboard of claim 1, the sailboard further comprising a mast mount integrally attached to the hull structure, the mast mount adapted to releasably engage a foot of the mast, and thereby to support the mast.

7. The sailboard of claim 4, wherein said dagger board is removably attached to the hull by means of friction between said fitting and said communicating channel.

8. An inflatable hull structure for a sailboard, the hull structure comprising a plurality of independently inflatable compartments, an upper surface, a lower surface, and at least one intra-compartmental through-hull channel communicating therebetween, the upper surface comprising a non-skid texturing and the lower surface smooth, whereby slippage by a sailboard operator on the upper surface and hydrodynamic drag on the bottom surface when the hull structure is in water are reduced, said hull structure comprising a maximum beam width which is between approximately ⅓ and approximately ⅔ an overall length of the hull.

9. The hull structure of claim 8, the hull structure further comprising a substantially rigid deck.

10. The hull structure of claim 9, wherein the deck is substantially enclosed by a covering on the inflatable hull.

11. The hull structure of claim 10, wherein the deck is attached to the upper surface of the hull.

12. The hull structure of claim 8, further comprising a mast mount attached to the hull structure.

13. The hull structure of claim 8, further comprising at least one dagger board attached to the hull structure.

14. The hull structure of claim 8, the hull being adaptable for use as a kayak and comprising a seat attached to the hull structure.

15. The hull structure of claim 8, the hull further comprising a removable substantially rigid deck.

16. The inflatable hull structure of claim 7, wherein said communicating channel is adapted for the removable attachment of said devices by means of friction between the devices and the communicating channel.

17. The hull structure of claim 13, wherein the dagger board is removably attached to the hull by means of friction between said dagger board and said communicating channel.

18. A sailboard comprising:

an inflatable hull, the inflatable hull comprising a plurality of independently inflatable compartments, the hull further comprising an upper surface and a lower surface and at least one intra-compartmental through-hull channel communicating therebetween;

a mast removably attached to the hull;

a boom adjustably and removably attached to the mast; and a sail attached to the mast and boom, the sail adapted to removably receive the mast in head and foot cups attached to the sail, the sail thereby attached to the mast;

said hull structure comprising a maximum beam width which is between approximately ⅓ and approximately ⅔ an overall length of the hull, and said through-hull channel comprising a channel wall adapted for the removable attachment of devices to the inflatable hull by means of friction between said fitting and said wall.

* * * * *